United States Patent [19]

Kunze

[11] Patent Number: 5,020,193

[45] Date of Patent: Jun. 4, 1991

[54] CONNECTOR

[75] Inventor: Harry A. Kunze, Pittsburgh, Pa.

[73] Assignee: Mine Safety Appliances Company, Pittsburgh, Pa.

[21] Appl. No.: 546,905

[22] Filed: Jul. 2, 1990

[51] Int. Cl.[5] ..... A44B 11/25

[52] U.S. Cl. ..... 24/323; 24/464

[58] Field of Search ..... 24/323, 322, 324, 191, 24/194, 68 CD, 616, 464; 297/483; 2/452

[56] References Cited

U.S. PATENT DOCUMENTS 973,147 10/1910 Van Alstyn ..... 24/464

2,797,465 7/1957 Kochler ..... 24/464

3,034,190 5/1962 Magnin et al. ..... 24/464

4,443,961 4/1984 Tiemann ..... 24/323

4,527,292 7/1985 Kasama et al. ..... 2/452

*Primary Examiner*—Victor N. Sakran

[57] ABSTRACT

Straps having a rigid buckle are removably attached to a unitary flexible mounting lug comprising a substrate, a web extending vertically from the substrate, an elongate flange extending from one side of the web and a lip extending from the opposite side of the web, whereby the lug can be deformed to receive the buckle and secure it between the substrate and the flange and lip.

8 Claims, 1 Drawing Sheet

CONNECTOR

FIELD OF THE INVENTION

This invention relates to connectors and more particularly to connectors for securing straps to a flexible breathing mask.

BACKGROUND OF THE INVENTION

Breathing masks conventionally comprise a facepiece made of rubber, synthetic rubber or flexible resin and a head harness. The head harness straps are sometimes permanently secured to the mask but it is preferred to have them removable. A variety of connectors have been used to removably connect harness straps to masks but they are complex and may require special tools for assembly and disassembly.

SUMMARY OF THE INVENTION

It is an object of the invention to provide a simple and inexpensive connection between a facepiece and a harness strap that can be assembled and disassembled by hand. In accordance with the invention, the connector comprises a unitary flexible mounting lug and a rigid slotted buckle, said mounting lug comprising a substrate, a web extending vertically from said substrate, an elongate flange extending from one side of said web substantially horizontal to and spaced from said substrate, and an opposing lip extending from the opposite side of said web, said buckle comprising a plate having a slot that passes said flange, lip and web on elastic deformation of the mounting lug, whereby the buckle is secured between the substrate and the flange and lip.

DESCRIPTION OF THE PREFERRED EMBODIMENT

Figure 1:
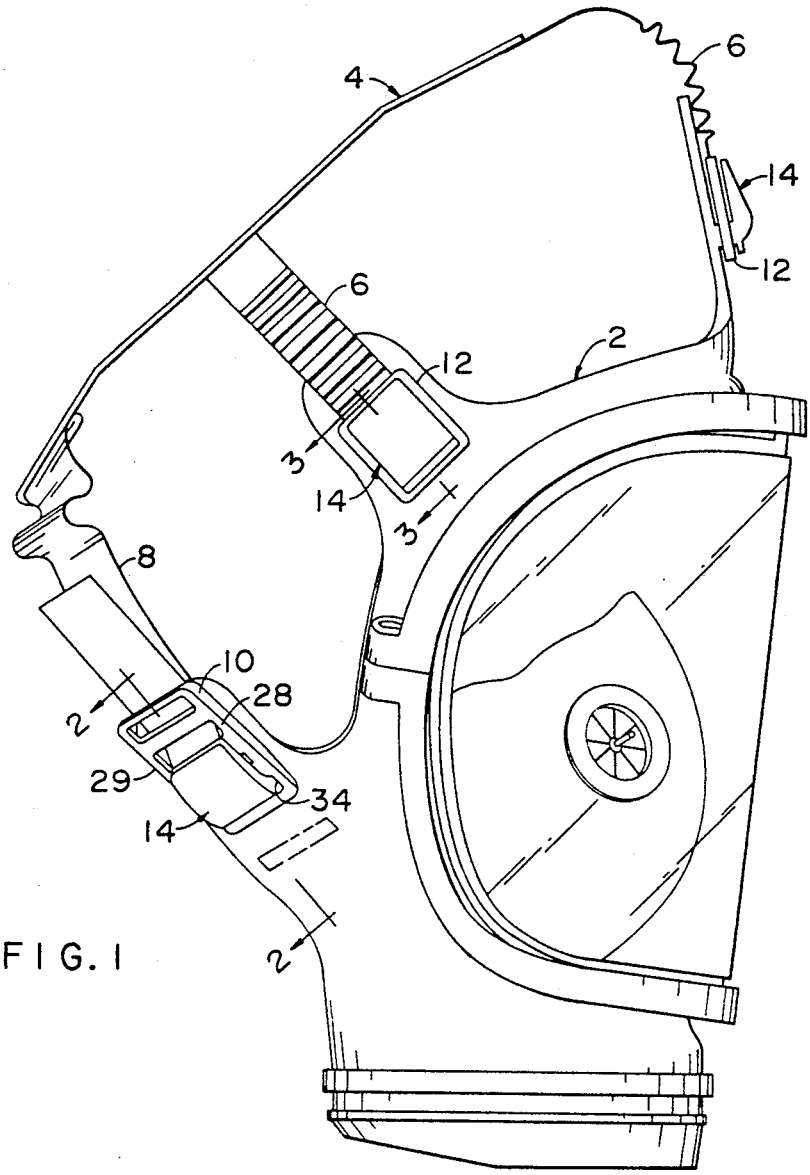
FIG. 1 is a side view of a breathing mask having connectors of this invention.
Figure 2:
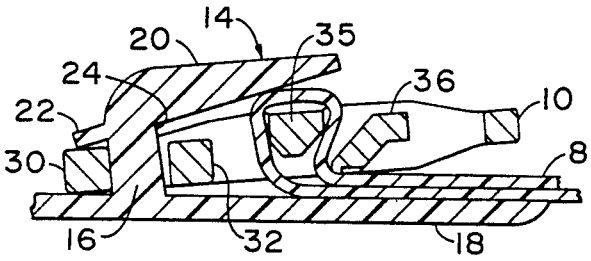
FIG. 2 through line 2—2 of FIG. 1.
Figure 3:
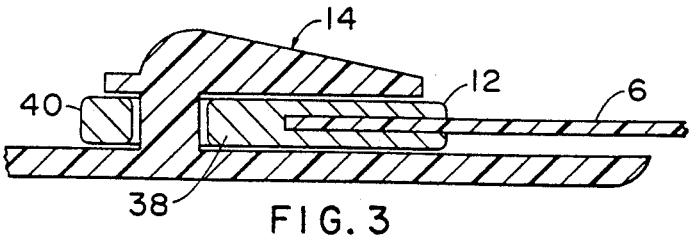
FIG. 3 is a section through line 3—3 of FIG. 1.

With reference to FIGS. 1–3, a breathing mask comprises a rubber-like facepiece 2 and a harness 4 comprising elastic straps 6 and adjustable straps 8. The straps are attached to slotted buckles 10 or 12 which are in turn removably secured to flexible mounting lugs 14 integrally molded with the mask.

As best seen in FIGS. 2 and 3, the mounting lug web 16 extends vertically from the facepiece substrate 18. An elongate flange 20 extends from one side of the web substantially horizontal to the substrate. The flange is tapered, and thus more flexible, toward its free end.

A lip 22 extends from the other side of the web and is preferably spaced the same distance as flange 20 from substrate 18. The free end of the web is curved on a radius, taken from point 24, equal to the thickness of the web.

As shown in FIGS. 1 and 2, a stiff buckle 10 for attachment to adjustable strap 8 has parallel side members 28 and 29 and cross members 30 and 32 forming a slot 34 that fits over mounting lug 14.

To secure the buckle to the face piece, the flange 20 is inserted through the slot in the buckle and the buckle is manually worked over lip 22 and web 16. The buckle is thus secured between the substrate and flange 20 and lip 22; it is very resistant against separation from forces applied through the strap. The buckle is easily removed by twisting it around the axis of the strap to release it over lip 22.

The adjustable straps 8 are threaded through crosspieces 35 and 36. The thickness of the buckle at crosspiece 35 is greater than the space between substrate 18 and flange 20, so the buckle tilts the mounting lug more tightly engaging lip 20 against the buckle.

The elastic straps 6, best seen in FIG. 3, are permanently secured to buckle 12. Buckle 12 has a slot formed by the buckle body 38 and crosspiece 40 that fits over the mounting lug as previously described.

Although this invention has been described particularly in relation to breathing masks, it will be recognized that the invention can be used for other purposes, within the scope of the appended claims.

I claim:

1. A unitary flexible mounting lug for receiving a slotted connector comprising a substrate, a web extending vertically from said substrate, an elongate flange extending from one side of said web substantially horizontal to and spaced from said substrate, and an opposing lip extending from the opposite side of said web, the flange and web being sized to fit through the slot in the slotted connector whereby the slotted connector slides over the flange and web to be secured between the substrate and the flange and lip.

2. A mounting lug of claim 1 in which the flange is thicker at the web than at its free edge.

3. A mounting lug of claim 1 in which the top of the web is curved on a radius equal to the thickness of the web.

4. A connector comprising a unitary, flexible mounting lug and a rigid slotted buckle, said mounting lug comprising a substrate, a web extending vertically from said substrate, an elongate flange extending from one side of said web substantially horizontal to and spaced from said substrate, and an opposing lip extending from the opposite side of said web, said buckle comprising a plate having a slot that passes said flange, lip and web on elastic deformation of the mounting lug, whereby the buckle is secured between the substrate and the flange and lip.

5. A connector of claim 4 in which the flange is thicker at the web than at its free edge.

6. A connector of claim 5 in which the flange and lip are spaced the same distance from the substrate.

7. A connector of claim 6 in which thickness of the buckle at a point along the flange and spaced from the web is greater than the distance between the substrate and the flange.

8. A connector of claim 4 in which the flange and lip are spaced the same distance from the substrate.

* * * * *